US007017270B2

(12) United States Patent
Shiba et al.

(10) Patent No.: US 7,017,270 B2
(45) Date of Patent: Mar. 28, 2006

(54) RECIPROCATION TYPE ELECTRIC SHAVER

(75) Inventors: Takeshi Shiba, Hikone (JP); Masaaki Sato, Hikone (JP); Ryo Motohashi, Hikone (JP)

(73) Assignee: Matsushita Electric Works, Ltd., Osaka (JP)

( * ) Notice: Subject to any disclaimer, the term of this patent is extended or adjusted under 35 U.S.C. 154(b) by 163 days.

(21) Appl. No.: 10/488,101

(22) PCT Filed: Sep. 24, 2002

(86) PCT No.: PCT/JP02/09804

§ 371 (c)(1),
(2), (4) Date: Mar. 8, 2004

(87) PCT Pub. No.: WO03/026854

PCT Pub. Date: Apr. 3, 2003

(65) Prior Publication Data

US 2004/0237310 A1 Dec. 2, 2004

(30) Foreign Application Priority Data

Sep. 25, 2001 (JP) ..... 2001-292456

(51) Int. Cl.
*B26B 19/04* (2006.01)

(52) U.S. Cl. ..... 30/43.92; 30/34.1; 30/527

(58) Field of Classification Search ..... 30/34.1, 30/43.92, 43.91, 527
See application file for complete search history.

(56) References Cited

U.S. PATENT DOCUMENTS

| | | | | |
|---|---|---|---|---|
| 4,796,359 | A | 1/1989 | Oprach et al. | 30/43.92 |
| 4,930,217 | A * | 6/1990 | Wolf et al. | 30/43.92 |
| 5,704,126 | A * | 1/1998 | Franke et al. | 30/34.1 |
| 6,301,786 | B1 * | 10/2001 | Oswald et al. | 30/43.92 |
| 6,357,118 | B1 * | 3/2002 | Eichhorn et al. | 30/43.92 |
| 6,892,457 | B1 * | 5/2005 | Shiba et al. | 30/43.92 |
| 6,931,731 | B1 * | 8/2005 | Izumi et al. | 30/43.1 |
| 2004/0010919 | A1 | 1/2004 | Shiba et al. | 30/43.92 |
| 2004/0128834 | A1 * | 7/2004 | Royle | 30/43.92 |

FOREIGN PATENT DOCUMENTS

| | | |
|---|---|---|
| EP | 0691187 | 1/1996 |
| GB | 2036631 | 7/1980 |
| GB | 2196895 | 5/1988 |
| JP | 55-86490 | 6/1980 |

(Continued)

*Primary Examiner*—Hwei-Siu C. Payer
(74) *Attorney, Agent, or Firm*—Greenblum & Bernstein, P.L.C.

(57) ABSTRACT

A reciprocating electric shaver (1) is provided. This reciprocating electric shaver (1) includes a main body block (8) and a head block (10), the head block (10) having four rotary connecting portions (32) at the front and the rear positions on the upper left and the upper right ends, the main body block (8) having four head support members (37), each of which can move up and down independently, and head floating springs (44) biasing upward each of the head support members (37) for floating, each of the head support members (37) of the main body block (8) being connected at the upper ends with each of the four rotary connecting portions (32) in a manner such that the head block (10) can rotate back and forth about the transverse direction of the shaver, thus allowing the head block (10) to rock back and forth relative to the main body block (8). As a result, even when the head block (10) is pressed against a skin with a small force, the head block (10) can excellently rock back and forth to conform to the contour of the skin.

17 Claims, 12 Drawing Sheets

FOREIGN PATENT DOCUMENTS

| | | | |
|---|---|---|---|
| JP | 60-175361 | * | 9/1985 |
| JP | 62-227395 | | 10/1987 |
| JP | 63-197484 | | 8/1988 |
| JP | 2731657 | | 12/1997 |
| JP | 10-43443 | | 2/1998 |
| JP | 2000-61173 | | 2/2000 |

* cited by examiner

RECIPROCATION TYPE ELECTRIC SHAVER

TECHNICAL FIELD

The present invention relates to reciprocating electric shavers in which blades perform reciprocating motion in contact with outer cutters for shaving operation.

BACKGROUND ART

A number of reciprocating electric shavers have been proposed in the past that include, for improving their quick shave performances, a plurality of cutter heads capable of rocking relative to the main body, thereby allowing the cutter heads to be maintained in close contact with the skin of a user.

For example, Japanese laid-open patent publication No. SHO 62-227395 discloses a shaver that is designed to allow a plurality of cutter heads to conform to the contour of a skin, even if the manner of shaving is varied, by providing a rotation axis near the upper end of a head block with the cutter heads such that the entire head block can rotate back and forth about the rotation axis. In the above construction, however, the rotation axis provided near the upper end of the head block results in decrease in distance between the rotation axis and an outer cutter in contact with the skin. This makes it hard to rotate the head block if the outer cutter is slantingly pressed against the skin with small pressure. Further, it is almost impossible in the construction to float the head block (i.e., to bias it upwardly into a rockable state). Therefore, the construction fails to sideways conform to the contour of the skin as well as to absorb, during shaving, impacts caused by, for example, unevenness at bone portions, and thus it may damage the skin as well as being uncomfortable in shaving.

Japanese laid-open patent publication No. SHO 55-86490 discloses a shaver that includes a plurality of cutter heads each independently floated for vertical movement by means of a respective spring such that, by the vertical movement of each of the cutter heads, the shaver can conform to the contour of a skin with unevenness as well as absorbing the impact. However, the above construction requires an initial load exceeding a predetermined value against the floating force (the upwardly biasing force by the spring) so as to hold down the overall oscillation of the cutter heads caused by drive of their blades. Thus, in order to conform to the contour of the skin, the cutter heads have to be pressed against the skin with a considerably large force. Further, if the outer cutter is slantingly pressed against the skin, the cutter head is not positioned perpendicular to the skin, thus failing to function effectively.

Japanese laid-open patent publication No. SHO 63-197484 discloses a shaver including a plurality of vertically movable cutter heads with a linkage coupling the cutter heads arranged adjacent to each other, such that one of the cutter heads moves up while the other moves down, for conforming to the contour of a skin. However, the above construction can hardly absorb an impact during shaving. Further, it cannot function effectively because the cutter heads fail to contact perpendicularly with the skin.

Japanese laid-open patent publication No. HEI 10-43443 discloses a shaver having cutter heads and a motor that are arranged to be movable as a unit in the front-rear, the transverse, and the vertical directions. However, the above construction has the fulcrum for movement of the cutter heads at the considerably lower part, thus failing to satisfactorily conform to the contour of the skin.

The present invention has been developed in view of the above mentioned problems, and it is an object of the present invention to provide a reciprocating electric shaver that allows all of the cutter heads to conform to the uneven contour of a skin in response to various ways of shaving, and that can absorb impacts caused by, for example, unevenness at bone portions.

DISCLOSURE OF THE INVENTION

In order to achieve the above purpose, an aspect of the present invention provides a reciprocating electric shaver having a main body block and a head block connected to an upper part of the main body block, the head block including arched outer cutters aligned in a front-rear direction of the shaver and blades which perform reciprocating motion, in a transverse direction of the shaver, in contact with insides of the outer cutters, wherein the head block includes four rotary connecting portions at front and rear positions on upper left and upper right ends for connection between the head block and the main body block, wherein the main body block includes four head support members, each of which can move up and down independently, and biasing members biasing upward the corresponding head support members for floating, and wherein each of the head support members of the main body block is connected at an upper end thereof with each of the four rotary connecting portions in a manner such that the head block can rotate back and forth about the transverse direction of the shaver, thus allowing the head block to rock back and forth relative to the main body block.

In the above configuration, in the case where the head support members connected with the front rotary connecting portions on the left and the right ends of the head block are moved down relative to the head support members connected with the rear rotary connecting portions, the head block is rotated relative to the main body block such that the upper surface is tilted forward. In the case where the head support members connected with the rear rotary connecting portions are moved down relative to the head support members connected with the front rotary connecting portions, the head block is rotated such that the upper surface is tilted backward. This allows the head block to favorably rock back and forth for conforming to the contour of a skin, even when it is pressed against the skin with a small force, thus ensuring that the outer cutter can be in contact with the skin substantially perpendicularly. Further, when pressed against the skin with a large force, the entire head block can be moved down for absorbing the impact.

Preferably, the improved shaver further comprises structures allowing a transverse distance between the upper end of each of the head support members and a corresponding rotary connecting portion of the head block to be freely changed, thus allowing the head block to rock side to side relative to the main body block. In this configuration, in the case where the head support members connected with the left rotary connecting portions of the head block are moved down relative to the head support members connected with the right rotary connecting portions, the head block is rotated relative to the main body block such that the upper surface is tilted leftward, while the transverse distances between the upper ends of the head support members and the rotary connecting portions of the head block are changed respectively. On the other hand, in the case where the right head support members are relatively moved down, the head block is rotated such that the upper surface is tilted rightward. This allows the head block to perform a side-to-side rocking motion for conforming to the contour of the skin, thus further ensuring that the outer cutter can be in contact with the skin substantially perpendicularly.

Preferably, in the above, the structure allowing the change of the transverse distance includes a pin penetrating in the transverse direction the upper end of the head support member and the rotary connecting portion of the head block for connection therebetween and a spring member retaining the pin in a manner that allows the pin to move sideways. This allows an elastic force of the spring member to be applied on the head block performing the side-to-side rocking motion, thus preventing unstableness of the head block which may cause uncomfortable vibrations on the skin of a user.

It is preferable in the improved shaver that, of the four rotary connecting portions, either two rotary connecting portions at the front positions on the left and the right ends of the head block or two rotary connecting portions at the rear positions on the left and the right ends of the head block are constructed to be prevented from moving back and forth relative to the corresponding head support members while the other rotary connecting portions are constructed to be movable back and forth relative to the corresponding head support members. This allows the head block to stably rock back and forth, thus facilitating the shaving operation.

It is preferable in the above that, in order to allow the rotary connecting portion to move back and forth relative to the head support member, the head support member has at the upper end an elongate hole extending in the front-rear direction and the head support member is connected with the rotary connecting portion through the elongate hole. This allows the rotary connecting portion of the head block to move back and forth, along the elongate hole, relative to the head support member. Thus, with such a simple configuration, the head block can stably rock back and forth, so that the shaving operation can be facilitated.

In the above, in order to allow the rotary connecting portion to move back and forth relative to the head support member, the head support member may be formed by coupling two members as one member of them can rotate back and forth relative to the other member. This allows the head block to stably rock back and forth for facilitating the shaving operation, with such a simple configuration.

Preferably, in the above, the two rotary connecting portions at the rear positions on the left and the right ends of the head block are constructed to be movable back and forth relative to the corresponding head support members. In this configuration, when a user moves the shaver upward with the skin, e.g. the cheek, kept nearly perpendicular to the shaver, the movement in the front-rear direction of the head block can be minimized such that the shaving operation can be improved.

In the improved shaver, preferably, at the left and the right ends of the head block, the rear rotary connecting portions are provided at positions lower than positions of the front rotary connecting portions. In this configuration, when a cheek or the like is shaved with the front outer cutter contacting skin, since the rear rotary connecting portion as the center of rotation is located near the center of gravity of the head block, the head block can be rotated largely even with a small pressing force. Further, when a chin is shaved with the rear outer cutter contacting the skin, since the front rotary connecting portion as the center of rotation is located near the upper end of the head block, the head block can be rotated smoothly even with a small force.

In the improved shaver, preferably, at the left and the right ends of the head block, the front rotary connecting portions are provided closer to the middle position in the front-rear direction of the head block than the rear rotary connecting portions are. In this configuration, when a cheek or the like is shaved with the front outer cutter contacting the skin, since there is a long distance between the point of contact with the skin and the rear rotary connecting portion as the center of rotation, the head block can be rotated largely even with a small pressing force.

It is preferable in the improved shaver that, at the left and the right ends of the head block, floating amount of the front rotary connecting portions is greater than floating amount of the rear rotary connecting portions. This can make it easy to rotate the head block largely when a cheek or the like is shaved with the front outer cutter contacting the skin, and thus ensuring that the head block can conform to the contour of the skin.

It is preferable in the improved shaver that, at the left and the right ends of the head block, floating force for the front rotary connecting portions is smaller than floating force for the rear rotary connecting portions. This allows the head block to be rotated largely even with a small pressing force, when a cheek or the like is shaved with the front outer cutter contacting the skin.

Preferably, in the improved shaver, the main body block further includes cylindrical guide portions guiding the head support members in the vertical direction and penetrating screws inserted upward into the guide portions for connection with the head support members, and lower parts of the head support members and the biasing members are accommodated in the guide portions, and each of the penetrating screws allows the corresponding head support member to be vertically movable relative to the main body block independent of other head support members. This allows the head block to be held, with the simple configuration, in a manner allowing its rocking motion relative to the main body block, thus contributing to decrease in overall dimension of the shaver.

Preferably, the improved shaver further comprises a drive unit accommodated in the head block for imparting reciprocating motion to the blade. This allows a driving force to be smoothly transmitted to the blade even when the position of the head block is considerably changed, thus allowing the head block to conform to the contour of a skin favorably compared to a case where a drive unit is accommodated in the main body block.

Preferably, in the above, the main body block further includes a power source for the drive unit accommodated in the head block, and the power source and the drive unit are connected via a wire running through a side of the main body block and a side of the head block. This allows the wire between the head block and the main body block to be lengthened, so that the wire can be prevented from being greatly bent even when the position of the head block is considerably changed. Accordingly, the resistance due to bending of the wire can be reduced in changing the position of the head block.

Preferably, in the above, the main body block further includes a power source for the drive unit accommodated in the head block, and the power source and the drive unit are connected via a wire running through a side of the main body block and through around a middle position between the front rotary connecting portions and the rear rotary connecting portions on a left or right side of the head block. This can prevent the wire from being greatly bent even when the position of the head block is considerably changed.

Accordingly, the resistance due to bending of the wire can be reduced in changing the position of the head block.

Preferably, the improved shaver further comprises a flexible cover for covering the wire, and both ends of the flexible cover are sealed such that the main body block and the head block can be waterproof. In this configuration, the entire reciprocating electric shaver is made waterproof, so that it can be washed in water for easy removal of cut hairs.

It is preferable in the improved shaver that the head block includes an outer cutter cassette having the outer cutters at an upper part thereof, and the outer cutter cassette includes a portion for engagement with the head block and a button portion for releasing the engagement with the head block by using the engaging portion. This allows the outer cutters to be easily detached, with such a simple configuration.

BEST MODES FOR EMBODYING THE INVENTION

Referring now to the accompanying drawings, preferred embodiments of the present invention will be described.

(Embodiment 1)

Figure 1:
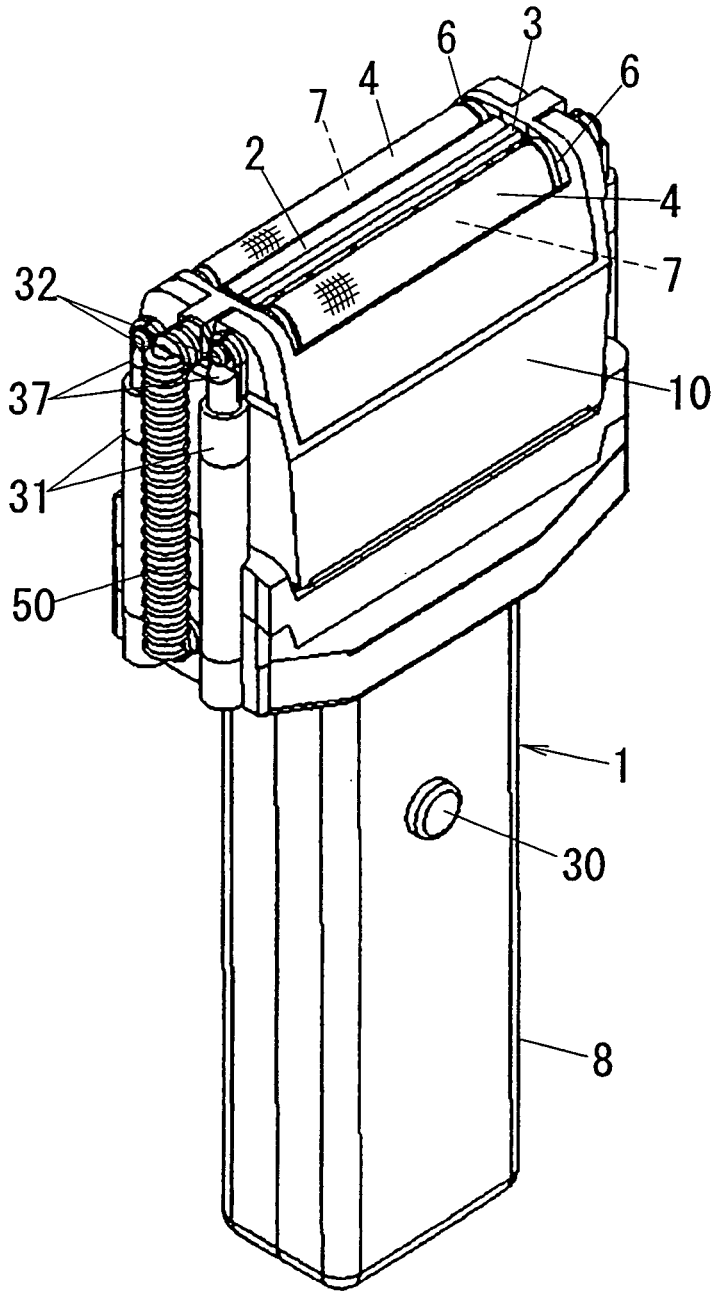
FIG. 1 is a perspective view of a reciprocating electric shaver according to Embodiment 1 of the present invention.

Embodiment 1 of the present invention will be described with reference to FIGS. 1 to 10. As shown in FIG. 1, a reciprocating electric shaver 1 according to this embodiment includes a main body block 8 having a switch 30 and a head block 10 connected to the upper part of the main body block 8 such that the head block 10 can rock back and forth, and side to side, and further can move up and down. The head block 10 includes a slit cutter assembly 3 that is provided substantially at the center of the upper part of the head block 10 and has at the top a slit cutter 2 for shearing long hairs, cutter heads 6 that are aligned in the front-rear direction with the slit cutter assembly 3 therebetween and have respective outer cutters 4, and blades 7 that are provided under the respective cutter heads 6 and perform reciprocating motions while being in contact with the corresponding outer cutters 4. It should be noted that the front and the rear or the right and the left referred to in this description are based on the case where the switch 30 is viewed in the front.

Figure 3:
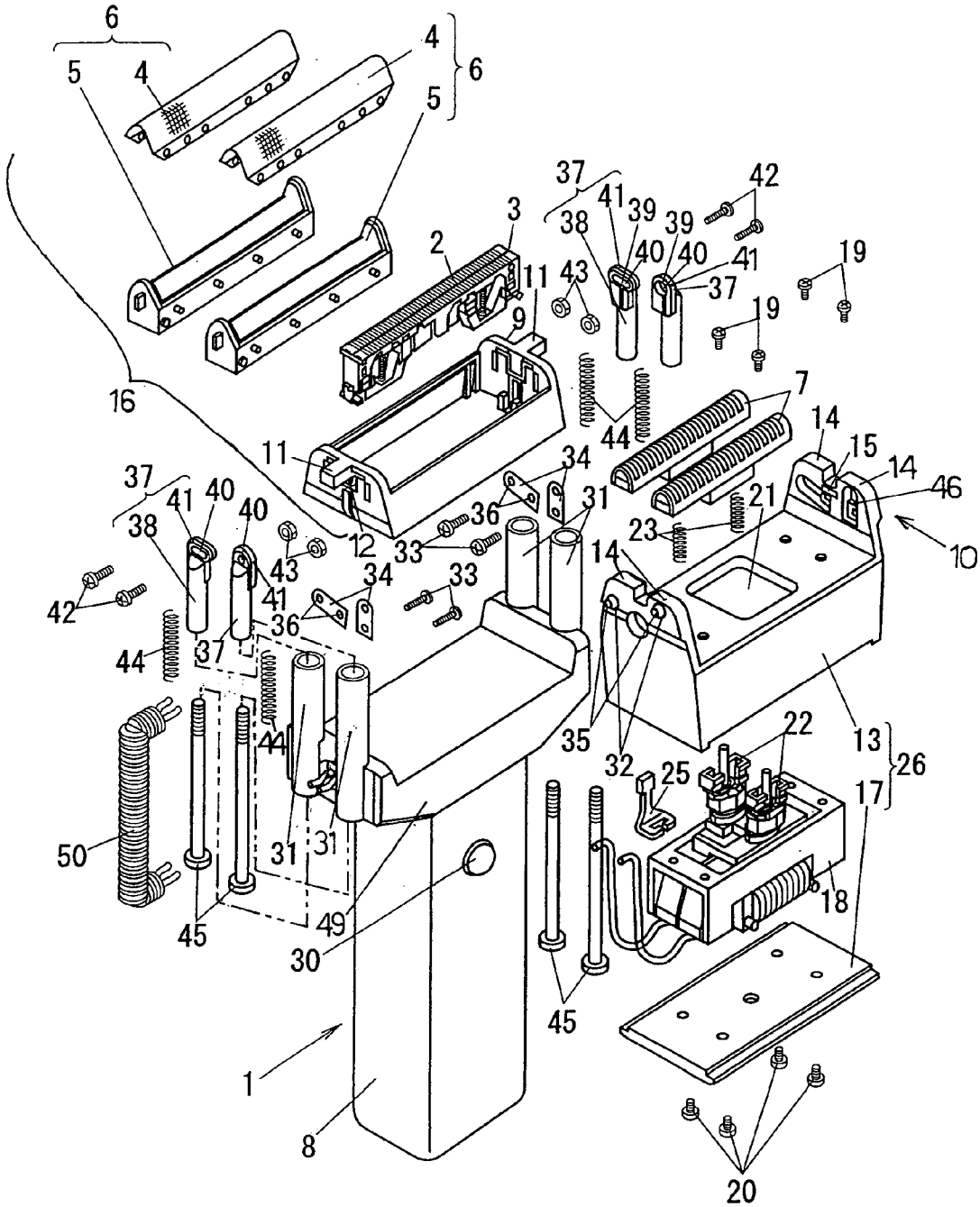
FIG. 3 is an exploded perspective view of the reciprocating electric shaver according to Embodiment 1.

FIG. 3 is an exploded perspective view of the reciprocating electric shaver 1. The cutter head 6 includes the outer cutter 4 constructed as a foil having apertures and an outer cutter mount 5 on which the outer cutter 4 is mounted in arched form. The cutter heads 6 and the slit cutter assembly 3 are mounted such that they can move vertically within a holding frame 9 whose top and bottom are open and that the outer cutters 4 and the slit cutter 2 for shearing long hair protrude upwardly, respectively.

Provided at the middle positions of the upper ends on the left and right sides of the holding frame 9 are button portions 11, below which engaging protrusions 12 (engaging portion in claim 17) are provided that come in and out of the holding frame 9 by pressing the button portions 11 upward. A box-shaped outer cutter frame 26 has on both sides upwardly projecting pieces 14, which has, at the insides, engaging recesses 15 for engagement with the engaging protrusions 12. Accordingly, an outer cutter cassette 16 composed of the holding frame 9, the slit cutter assembly 3, and the cutter heads 6 can be coupled to the outer cutter frame 26 between its two projecting pieces 14, with the engaging protrusions 12 engaged with the engaging recesses 15. The outer cutter frame 26 and the outer cutter cassette 16 constitutes the head block 10. The engagement between the engaging protrusion 12 and the engaging recess 15 can be released by depressing the button portion 11 upward. Thus, the outer cutter cassette 16 is detachable from the outer cutter frame 26.

The outer cutter frame 26 is a box-shaped member. The outer cutter frame 26 has its upper cover 13 and its under cover 17 which closes the bottom opening of the upper cover 13. The outer cutter frame 26 contains a linear motor 18. The linear motor 18 is fastened to the upper cover 13 with an screw 19, and is fastened to the under cover 17 with a screw 20.

Provided substantially in the center of the upper surface of the outer cutter frame 26 is an opening 21, through which a pair of reciprocating limbs 22 provided at the upper part of the linear motor 18 are upwardly projected out of the outer cutter frame 26. The reciprocating limbs 22 reciprocate sideways. Each of the blades 7 is mounted at the upper end of each of the reciprocating limbs 22 with a blade biasing spring 23 biasing it upwardly, so that the blade 7 can perform, with the outer cutter cassette 16 attached, a sideways reciprocating motion in close contact with the inside of the outer cutter 4. The slit cutter 2 of the slit cutter assembly 3 is coupled to a slit drive lever 25 attached to one of the reciprocating limbs 22 so as to be driven by the reciprocating limb 22.

The above description is made mainly as to the configuration of the head block 10. Now, a description will be made as to the mechanism for coupling the head block 10 to the main body block 8 in a manner that allows the head block to rock back and forth, and side to side, and further to move up and down, relative to the main body block 8.

Each of the two projecting pieces 14 of the outer cutter frame 26 of the head block 10 have two round rotary connecting portions 32, each projecting from the outer surface, at the front and the rear positions. In other words, the outer cutter frame 26 has four rotary connecting portions at the front and the rear positions on the left and the right sides. Each of the rotary connecting portions 32 has a central through hole 35 formed through the projecting piece 14. The rotary connecting portions 32 at the front positions are located in the vicinity of the upper end of the outer cutter frame 26 while the rotary connecting portions 32 at the rear positions are provided at lower positions than ones at the front positions. Further, the front rotary connecting portions 32 are arranged closer to the middle position in the front-rear direction of the outer cutter frame 26 than the rear rotary connecting portions 32 are. In addition, as shown in detail in FIG. 6, a rectangular screw retaining plate 34 (spring member in claim 3) having holes 36 at both ends is provided on the inside of the projecting piece 14, and one of fixing screws 33 is inserted in one of the holes 36 for fixing the screw retaining plate 34 to the inside of the projecting piece 14.

Figure 6:
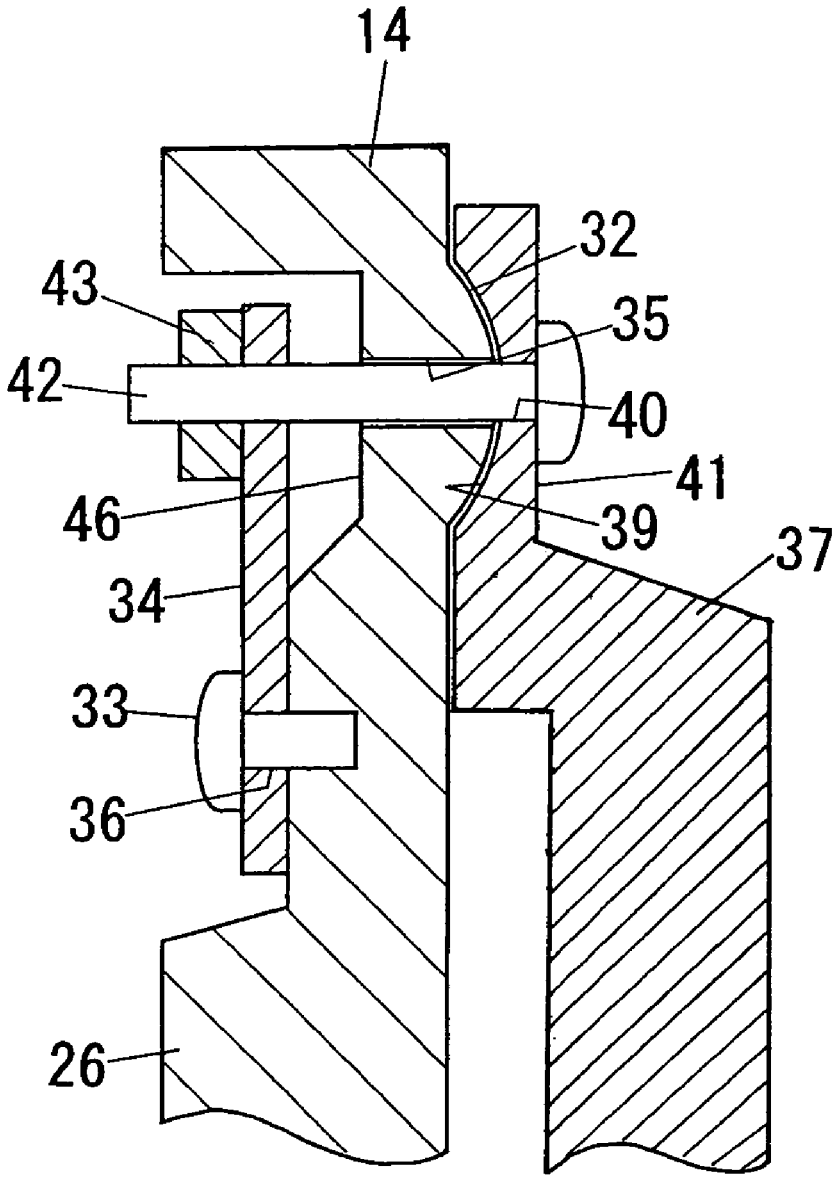
FIG. 6 is a cross sectional view illustrating the structure of a connecting portion between the head block and a main body block of the reciprocating electric shaver according to Embodiment 1.

A head support member 37 includes a cylindrical portion 38 having a hole at the bottom, and an extension piece 41 that is provided on the top of the cylindrical portion 38 and has a round recess 39 and a screw insertion through hole 40 formed in the center of the round recess 39 as shown in FIG. 6. The screw insertion hole 40 of the head support member 37 at the front position is substantially circular while that of the rear head support member 37 is in the shape of a horizontally elongated ellipse. Each of the four rotary connecting portions 32 is fitted in the round recesses 39 of the head support member 37. In this state, a holding screw 42 (pin in claim 3) is inserted through the screw insertion hole 40 and the through hole 35 from the outside of the projecting piece 14, and further, the tip of the holding screw 42 that protrudes at the inside of the projecting piece 14 passes through an upper hole of the holes 36 of the screw retaining plate 34. The holding screw 42 is prevented from coming off with a nut 43 attached on the tip side for pressing the screw retaining plate 34 against the inner side of the projecting piece 14.

The above configuration allows the head support members 37 to support the outer cutter frame 26, i.e., the head block 10, at the front and rear positions of each side in a manner allowing the back-and-forth rotation. The inside of the projecting piece 14 is provided with a recess 46 around the through hole 35, so that a clearance is formed between the screw retaining plate 34 and the recess 46.

Figure 2:
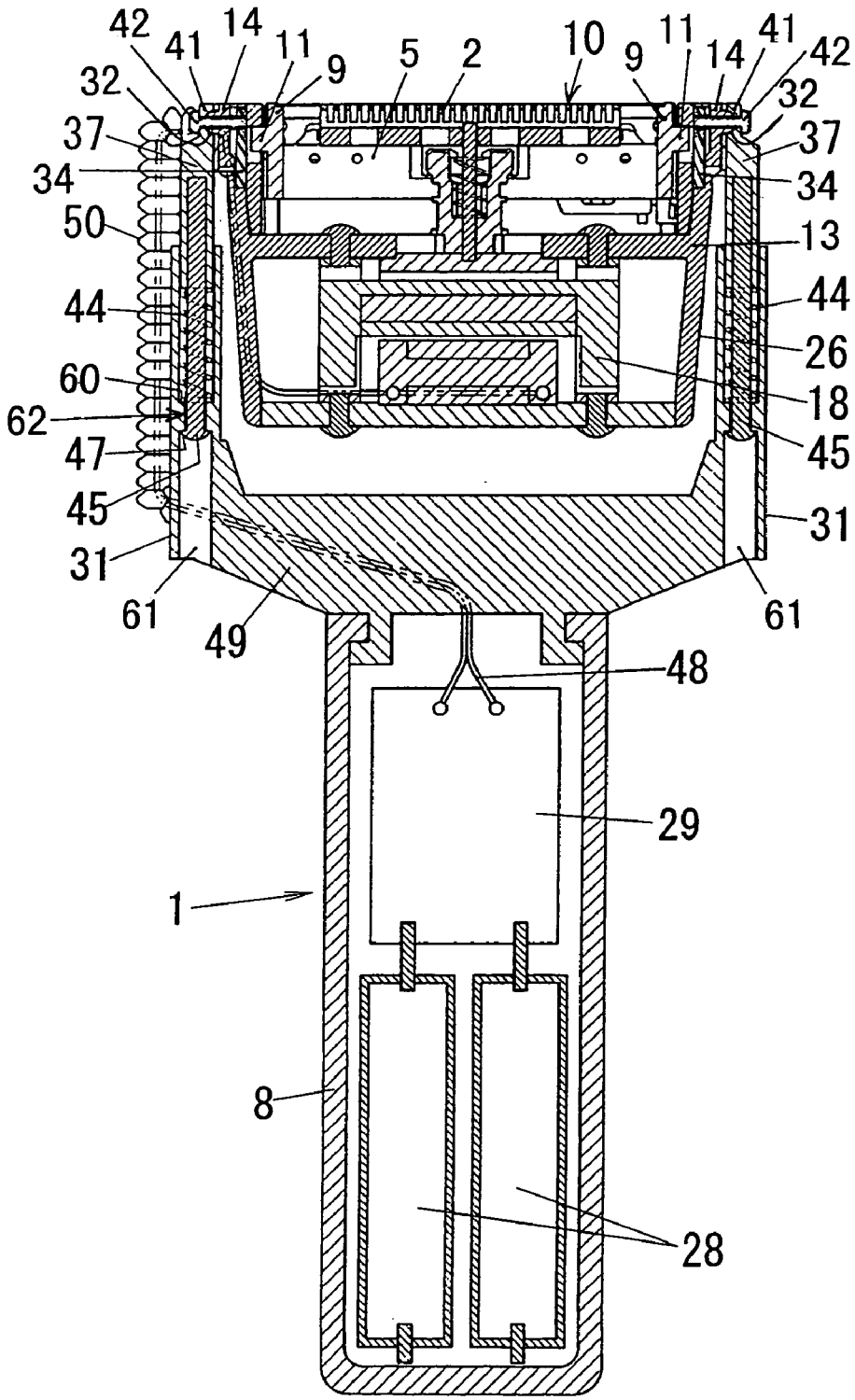
FIG. 2 is a cross sectional view of the reciprocating electric shaver according to Embodiment 1.

As shown in FIG. 2, the main body block 8 houses a battery 28 (power source) for driving the linear motor 18 and a circuit 29 connected with the battery 28, as well as having the switch 30 at the front side. As shown in FIG. 3, the main body block 8 includes at the top a cutter head holding body 49, which has four cylindrical portions (guide portions in claim 12) 31, each having a through hole along the full length, at the front and rear positions on the left and the right sides. Some part of the through hole 61 of the cylindrical portion 31 is made smaller in diameter than others. This small diameter portion 62 has step portions 60 and 47 at the upper and the lower ends respectively. The cylindrical portion 31 accommodates inside the through hole 61 a head floating spring (biasing member in claim 12) 44 for biasing the head block 10 upwardly. The head floating spring 44 is held inside the through hole 61 of the cylindrical portion 31 with the bottom stopped by the step portion 60 of the cylindrical portion 31. The head support member 37 that supports the head block 10 is inserted into the through hole 61 from the upper opening of the cylindrical portion 31 and biased upwardly by the head floating spring 44 into a vertically movable state (referred to as "floating state" hereinafter). Inserted from the bottom opening of the cylindrical portion 31 is a head fixing screw (penetrating screw in claim 12) 45, the upper end of which is coupled to the lower end of the head support member 37. The lower end of the head fixing screw 45 is stopped by the step portion 47 of the small diameter portion 62 in the through hole 61 of the cylindrical portion 31, so that the upward movement of the head fixing screw 45 can be limited within a predetermined range. According to the above configuration, the head block 10 can be mounted above the main body block 8 in the floating state for vertical movement via the four head support members 37. The floating amount (the range for vertical movement) of the two head support members 37 at the front positions are arranged to be greater than that of the two head support members 37 at the rear positions. The floating force of the two head floating springs 44 biasing upwardly the head support members 37 at the front positions is arranged to be smaller than that of the two head floating springs 44 at the rear positions.

A wire 48 for supply of electric power to the linear motor 18 accommodated in the outer cutter frame 26 of the head block 10 is run through the inside of the main body block 8, exposed out of a through hole, not shown, which is formed in the left side of the cutter head holding body 49, and then drawn into the inside of the outer cutter frame 26 through near the rotary connecting portion 32 of the projecting piece 14 at the left side of the outer cutter frame 26, for connection to the linear motor 18. This can reduce the reaction force due to bending of the wire 48 in response to a movement of the head block 10, thus allowing the head block 10 to conform to the contour of the skin favorably. Preferably, the wire 48 is drawn into the outer cutter frame 26 around the middle position between the two rotary connecting portions 32 at the left side of the outer cutter frame 26 (around a middle position between the rotary connecting portions, in claim 15). This can prevent the wire 48 from great bending even if the head block 10 changes the position considerably.

The exposed part of the wire 48 is covered with a flexible cover 50. The connecting portion between the flexible cover 50 and the left side of the cutter head holding body 49, and the connecting portion between the flexible cover 50 and the projecting piece 14 of the outer cutter frame 26 are sealed respectively. In addition, the main body block 8 in this embodiment is configured to be waterproof. Thus, the entire reciprocating electric shaver 1 can be washed in water.

Figure 4:
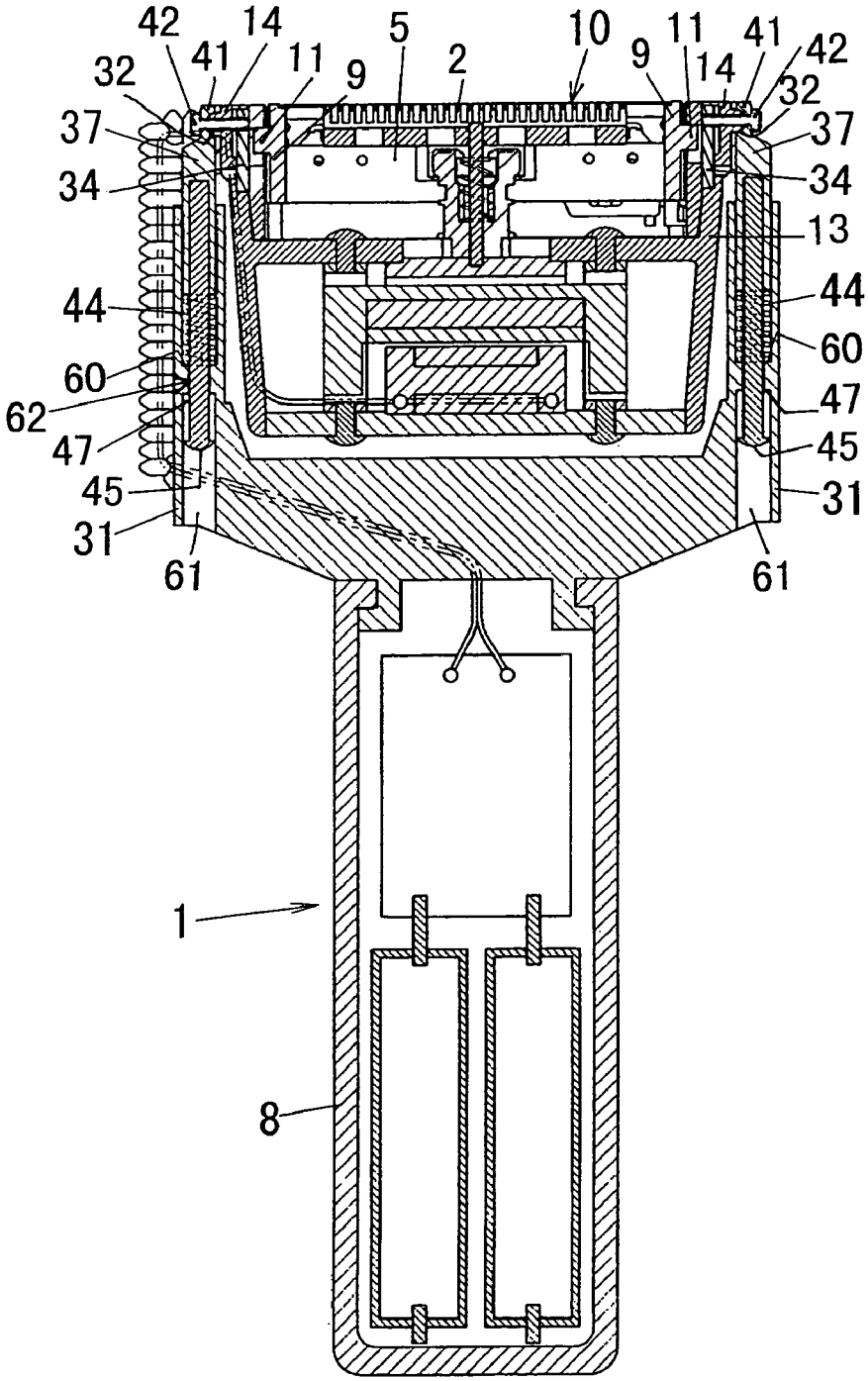
FIG. 4 is a cross sectional view of the reciprocating electric shaver according to Embodiment 1, with a head block in a lowered position.

As described above, when the head block 10 is pressed against the skin or when an impact arises during shaving due to, for example, unevenness around a bone portion, this reciprocating electric shaver 1 can absorb the impact by moving downward the head support members 37, i.e., the entire head block 10, against the biasing force of the head floating springs 44 as shown in FIG. 4. The downward movement of the head block 10 can be stopped in a predetermined position with the bottom of the head support members 37 abutting against the step portions 60 of the small diameter portions 62 of the cylindrical portions 31.

Figure 9:
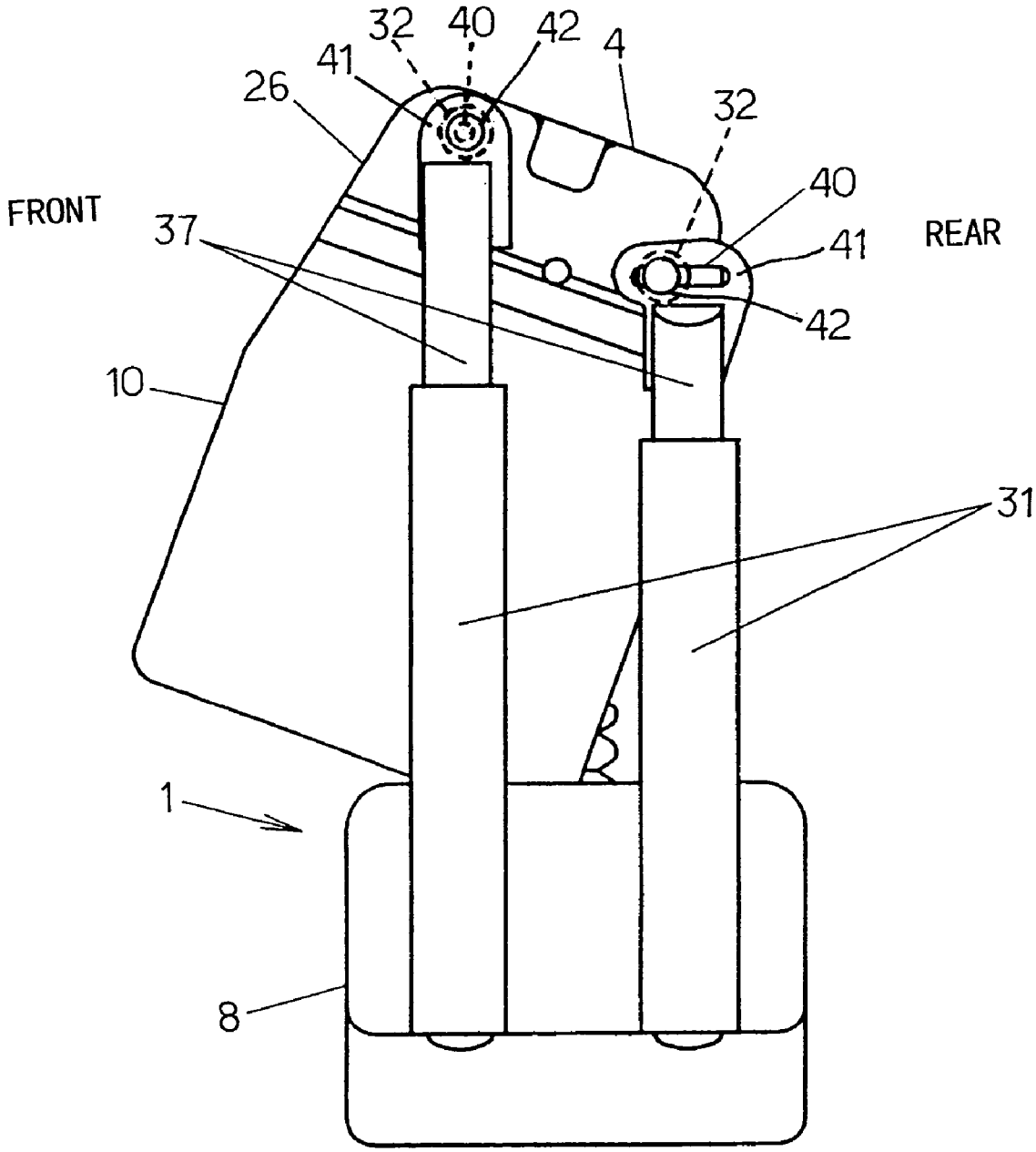
FIG. 9 is a side view illustrating a relative position between the head support member and the rotary connecting portion of the reciprocating electric shaver according to Embodiment 1, with the head block tilted backward.
Figure 10:
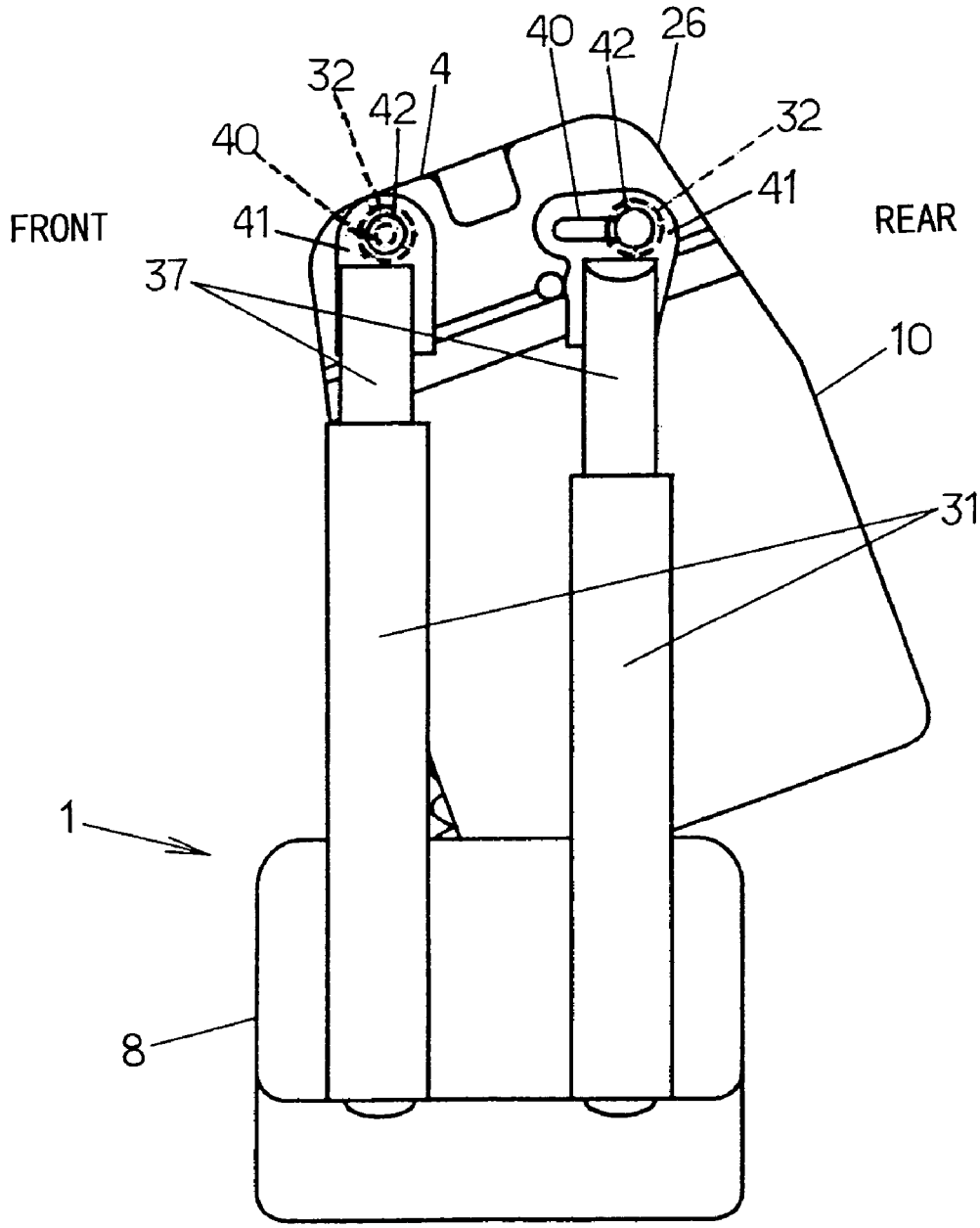
FIG. 10 is a side view illustrating a relative position between the head support member and the rotary connecting portion of the reciprocating electric shaver according to Embodiment 1, with the head block tilted forward.

The four head support members 37 are capable of moving up and down independently of one another. Therefore, for example, when the rear outer cutter 4 is in contact with the skin, as shown in FIG. 9, the head block 10 rotates about the two front rotary connecting portions 32 with the two rear head support members 37 moving downward respectively, thereby causing the upper surface with the outer cutters 4 to be tilted backward. On the other hand, when the front outer cutter 4 is in contact with the skin, as shown in FIG. 10, the head block 10 rotates about the two rear rotary connecting portions 32 with the two front head support members 37 moving downward respectively, thereby causing the upper surface with the outer cutters 4 to be tilted forward. Accordingly, by pressing the cutter head 6 against the skin, the head block 10 can be rotated to conform to the contour of the skin.

Moreover, the above structure includes a pair of rotary connecting portions 32 at each of the front and the rear. This can provide a lot of distance between the cutter head 6 in contact with the skin and the pair of rotary connecting portions 32 which are the center of back-and-forth rotation of the head block 10, regardless of the direction of contact with the skin. Accordingly, even when pressure applied for shaving is small, great moment can be produced for rotating the head block 10 back and forth, thus allowing the head block 10 to excellently conform to the contour of the skin.

When the head block 10 rotates back and forth in the above manner, the distance in the front-rear direction between the front and the rear rotary connecting portions 32 changes, which causes a discrepancy relative to the distance in the front-rear direction between the front and the rear head support members 37. In view of that, in this embodiment, the screw insertion hole 40 in the front head support member 37 is configured to be substantially circular such that the front rotary connecting portion 32 can be prevented from moving back and forth while the screw insertion hole 40 (an elongate hole in claim 5) in the rear head support member 37 is in the shape of a horizontally elongated ellipse such that the rear rotary connecting portion 32 can move back and forth within a predetermined range. This configuration allows the head block 10 to be smoothly rotated back and forth.

There may be a method in which both the front and the rear rotary connecting portions 32 are movable back and forth in order to absorb the discrepancy in the distances in the front-rear direction. In such a method, although the head block 10 can be rotated back and forth easily, it may be unstable during use, thus becoming considerably hard to use. There may be another method where, contrary to this embodiment, the front rotary connecting portion 32 is movable back and forth within a predetermined range while the rear rotary connecting portion 32 is prevented from moving back and forth. In such a method, the head block 10 can be rotated back and forth smoothly without being unstable in use. However, when using a shaver, a user generally moves the shaver upward with the skin, e.g. the cheek, kept nearly perpendicular to the shaver. In such a case, the above method causes the head block 10 to be moved backward as well as being rotated while the upper surface with the outer cutters 4 is tilted forward to conform to the contour of the skin, thereby making the shaver 1 difficult to use.

On the other hand, the configuration of the screw insertion holes 40 according to this embodiment allows the head block 10 not only to be smoothly rotated back and forth but also to be stable during use. Further, in the case where a user moves the shaver 1 upward with the skin, e.g. the cheek, kept nearly perpendicular to the shaver 1, the movement of the head block 10 can be minimized, so that the shaving operation is facilitated.

In this reciprocating electric shaver 1, the linear motor 18 as a drive unit is located at the lower part of the head block 10, so that the weight of the head block 10 is increased and the center of gravity thereof is lowered. However, as described above, the rear rotary connecting portion 32 is provided at a position lower than that of the front rotary connecting portion 32. Therefore, when a cheek or the like is shaved while the front outer cutter 4 is in contact with the skin and the upper surface of the head block 10 is tilted forward as shown in FIG. 10, the rear rotary connecting portion 32 as the center of rotation is located near the center of gravity of the head block 10. Thus, the effect of the weight of the head block 10 can be reduced so that the head block 10 can be rotated largely even with a small force.

In addition, as described above, the rear rotary connecting portion 32 is relatively far away from the middle position in the front-rear direction of the outer cutter frame 26. This arrangement can produce, in shaving of a cheek or the like, increased distance between the point of contact with the skin and the center of rotation, i.e., the rear rotary connecting portion 32, thus further facilitating the rotation of the head block 10.

Further, as described above, the floating amount of the front head support member 37 is greater than that of the rear head support member while the floating force for the front head support member is smaller than that for the rear head support member 37. This can still more facilitate, in shaving of a cheek or the like, the rotation of the head block 10, thus ensuring that the head block 10 can conform to the contour of the skin.

In the case where, for shaving of a chin, the rear outer cutter 4 is in contact with the skin with the upper surface of the head block 10 being tilted backward as shown in FIG. 9, the front rotary connecting portion 32 acts as the center of rotation and only a considerably small force is applied for rotating the head block 10. However, since the front rotary connecting portion 32 is located in the vicinity of the upper end of the cutter head 6 as described above, the rotation can be smoothly performed even with such a small force.

Figure 5:
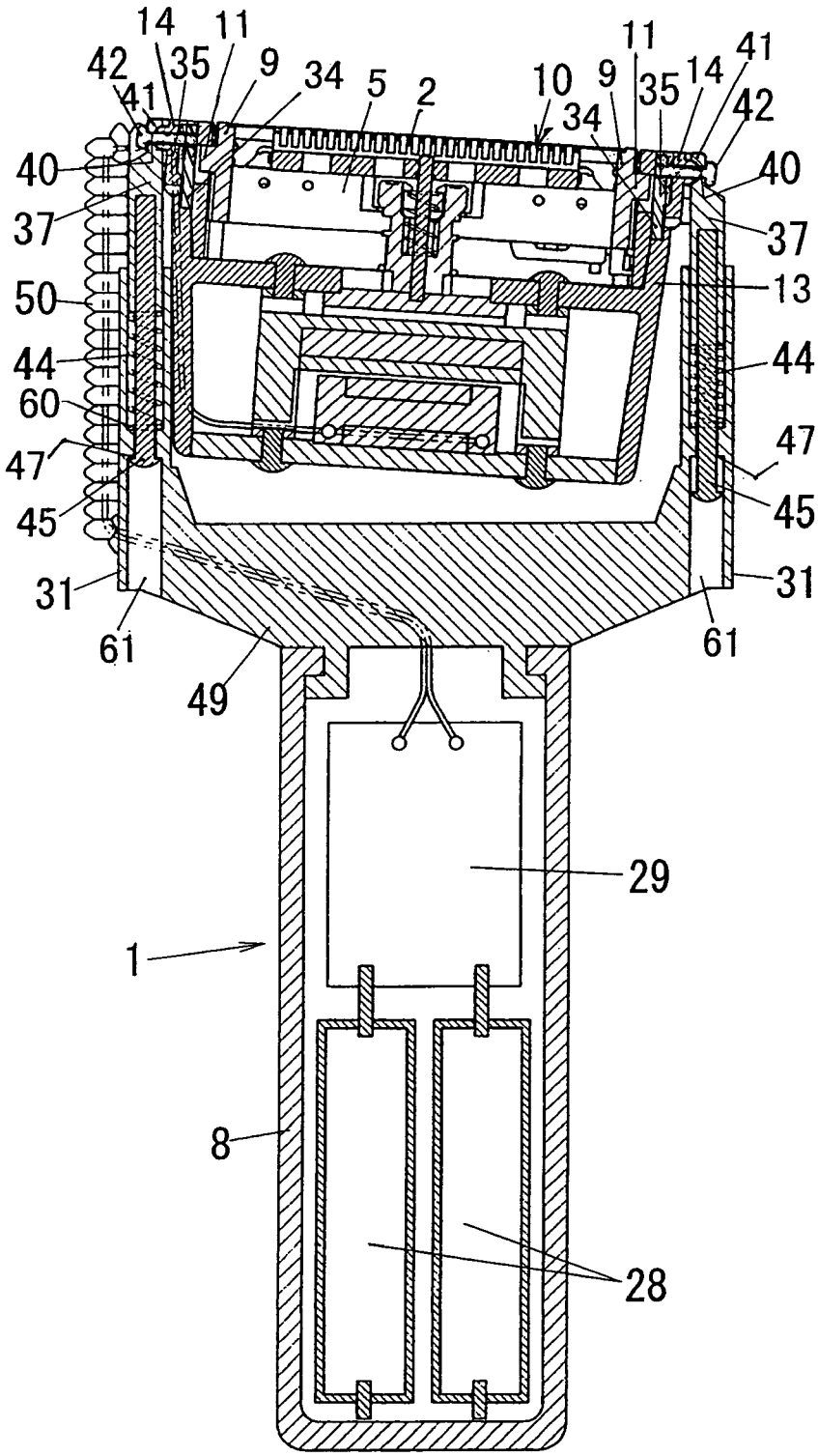
FIG. 5 is a cross sectional view of the reciprocating electric shaver according to Embodiment 1, with the head block tilted toward the right side.

FIG. 5 illustrates a state in which the head block 10 of the reciprocating electric shaver 1 is rotated such that the upper surface is tilted toward the right side. In such a case, where the right head support member 37 is moved down relative to the left head support member 37, the head block 10 rotates clockwise as viewed from the front. Similarly, when the left head support member 37 is moved down, the head block 10 rotates counterclockwise as viewed from the front. Thus, the head block 10 can perform a side-to-side rocking motion for conforming to the contour of the skin more reliably.

Figure 7:
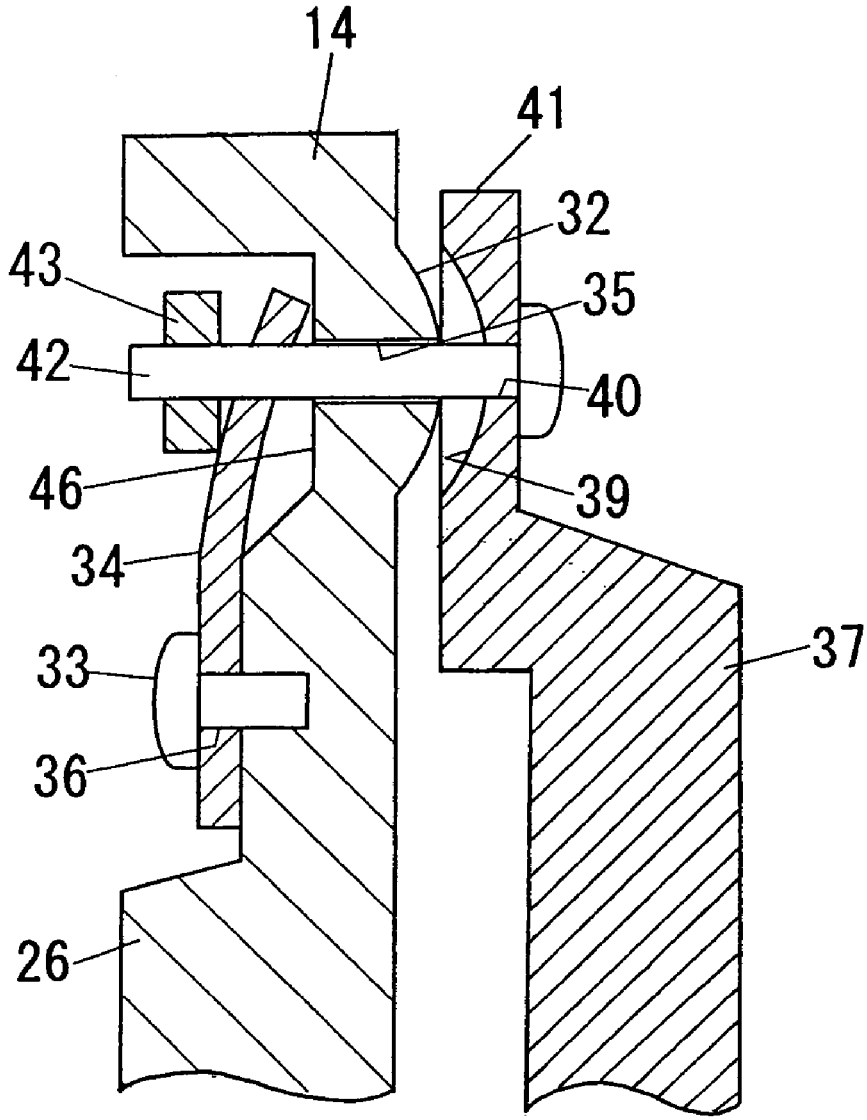
FIG. 7 is a cross sectional view of the connecting portion between the head block and the main body block of the reciprocating electric shaver according to Embodiment 1, with a screw retaining plate in a bent position.
Figure 8:
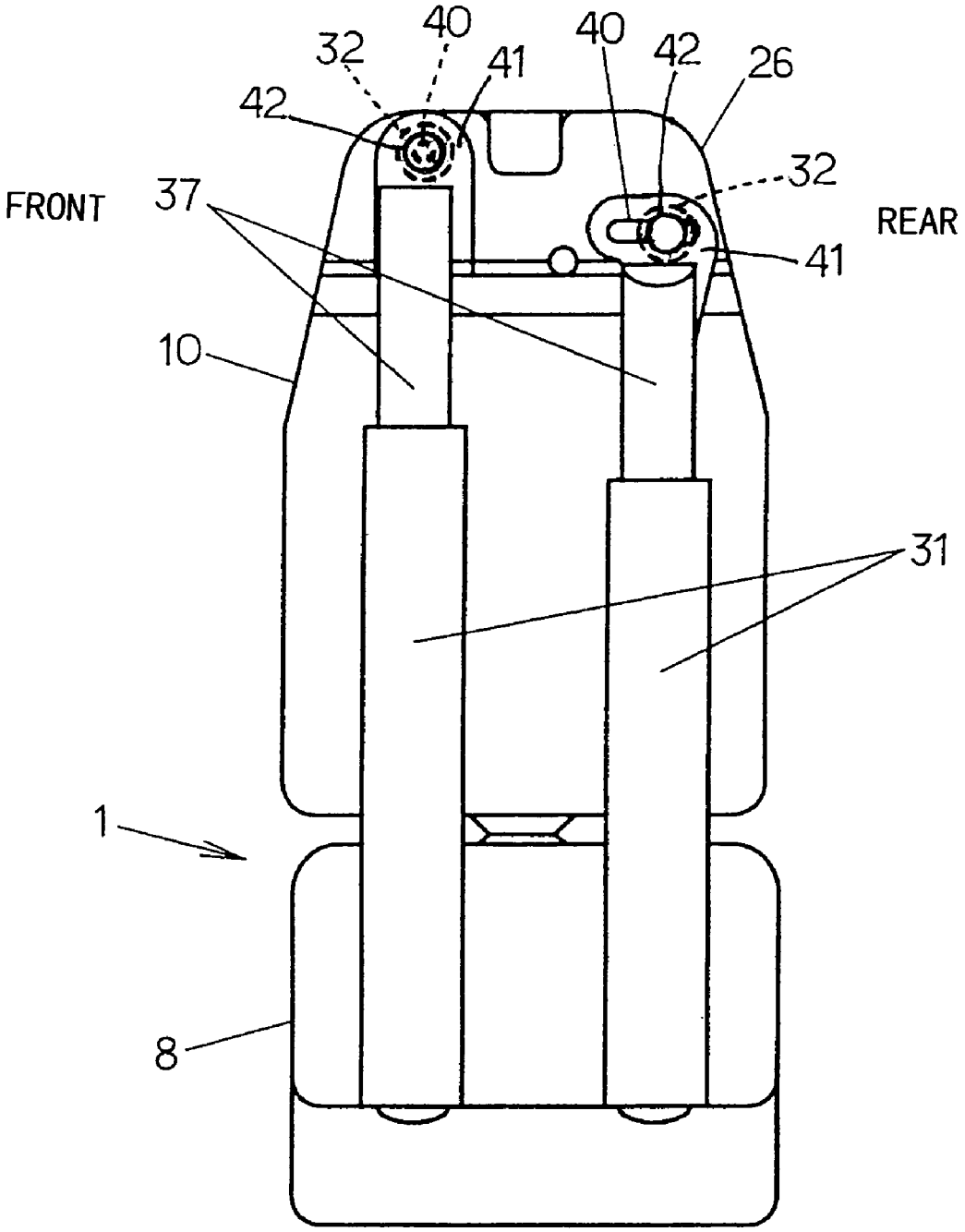
FIG. 8 is a side view illustrating a relative position between a head support member and a rotary connecting portion of the reciprocating electric shaver according to Embodiment 1, with the head block tilted neither forward nor backward.

When the head block 10 is inclined toward the right side or the left side, the relation changes between the distance between the screw insertion holes 40 in the right and the left head support members 37, and the distance between the through holes 35 in the right and the left sides of the head block 10. In this embodiment, however, the head support member 37 is retained with the holding screw 42, which is retained with the screw retaining plate 34, with the clearance formed between the screw retaining plate 34 and the bottom of the recess 46 in the projecting piece 14. This configuration allows the upper part of the screw retaining plate 34 to be bent as shown in FIG. 7 such that the holding screw 42 can move sideways while receiving the spring force. Accordingly, even when this discrepancy arises, the projecting piece 14 and the head support member 37 can be prevented from receiving a force that may cause a deformation of them, while the head block 10 can be prevented from unstable oscillation, which may impair the shaving performances or produce a noise, due to a side-to-side movement of the holding screw 42. The structure including the holding screw 42 and the screw retaining plate 34 corresponds to the structure for allowing the change of the transverse distance in claims 2 and 3.

It will be appreciated from the above description that the head block 10 can largely rock back and forth, and side to side for conforming to the contour of the skin. Since the linear motor 18 is accommodated in the head block 10 as described above, even when the head block 10 changes the position considerably, the driving force can be efficiently transmitted via the reciprocating limbs 22 and the slit drive lever 25 into the blades 7 and the slit cutter assembly 3. On the other hand, if the linear motor 18 is located in the main body block 8 with the reciprocating limbs 22 and the slit drive lever 25 projecting upward for transmission of the driving force to the head block 10, the head block 10 should be considerably limited in movement so as to secure the transmission of the driving force, thus failing to conform to the contour of the skin in a desired manner.

(Embodiment 2)

Figure 11:
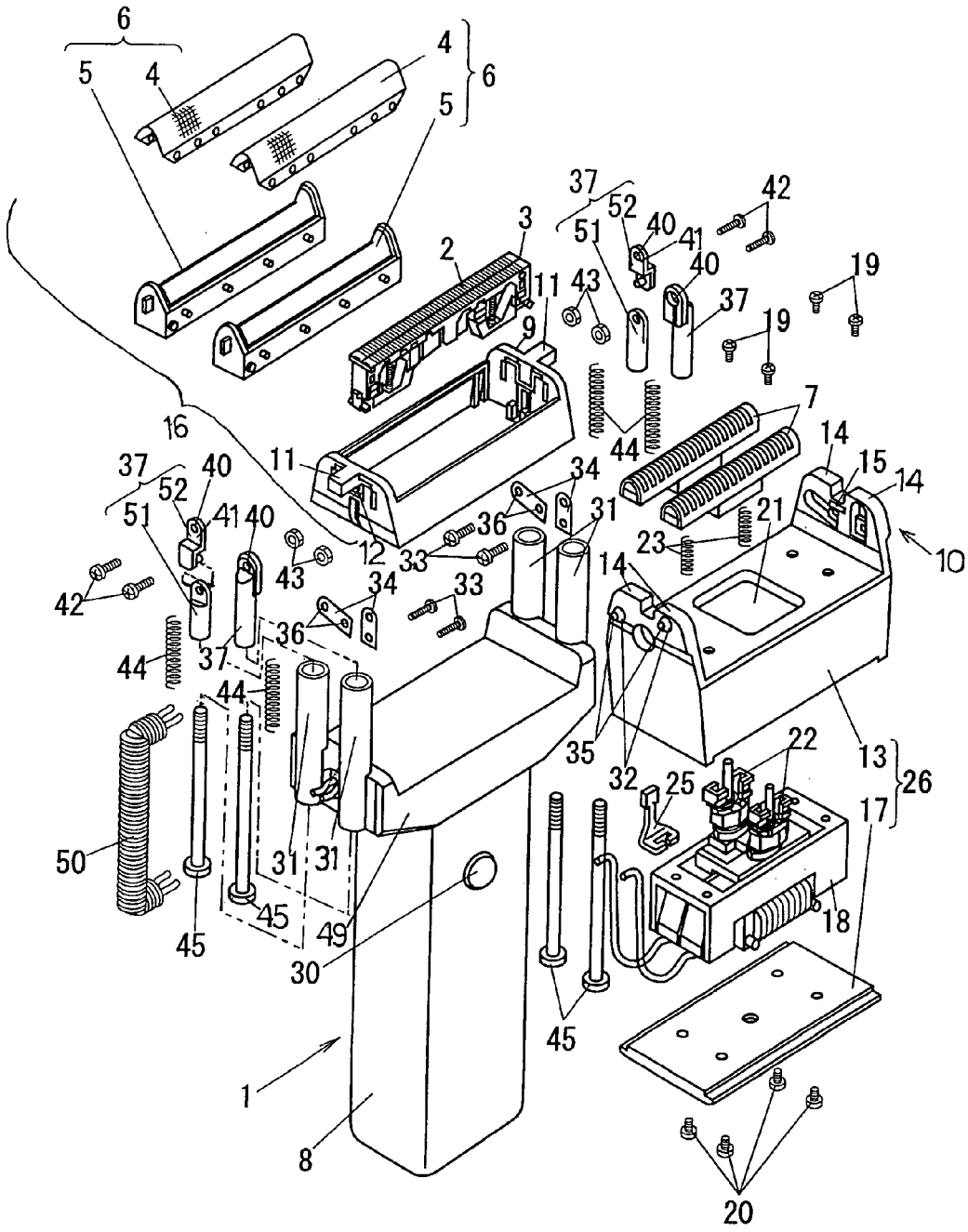
FIG. 11 is an exploded perspective view of a reciprocating electric shaver according to Embodiment 2.

Referring now to FIG. 11, Embodiment 2 of the present invention will be described. A reciprocating electric shaver 1 according to this embodiment has a configuration similar to Embodiment 1, which will be explained in no more detail, but is different from Embodiment 1 in that it has a rear head support member 37 composed of two members, i.e., a main body connecting member 51 and a link member 52 rotatably coupled thereto. The coupling is performed by inserting a cylindrical protrusion formed on the lower end of the link member 52 into a round hole formed in the upper end of the main body connecting member 51 and then by caulking the tip of the protrusion, so that the link member 52 can rotate back and forth. The link member 52 is connected with a rotary connecting portion 32 of a head block 10 through a holding screw 42, so that the rotation of the link member 52 allows the rotary connecting portion 32 to move back and forth relative to a main body block 8.

The above configuration allows, in a manner similar to Embodiment 1, the head block 10 to be smoothly rotated back and forth without being unstable during use as well as minimizing the unwanted movement of the head block 10 when a user moves the shaver 1 upward with the skin being shaved, e.g. the cheek, kept nearly perpendicular to the shaver 1, thus facilitating the shaving operation.

(Embodiment 3)

Figure 12:
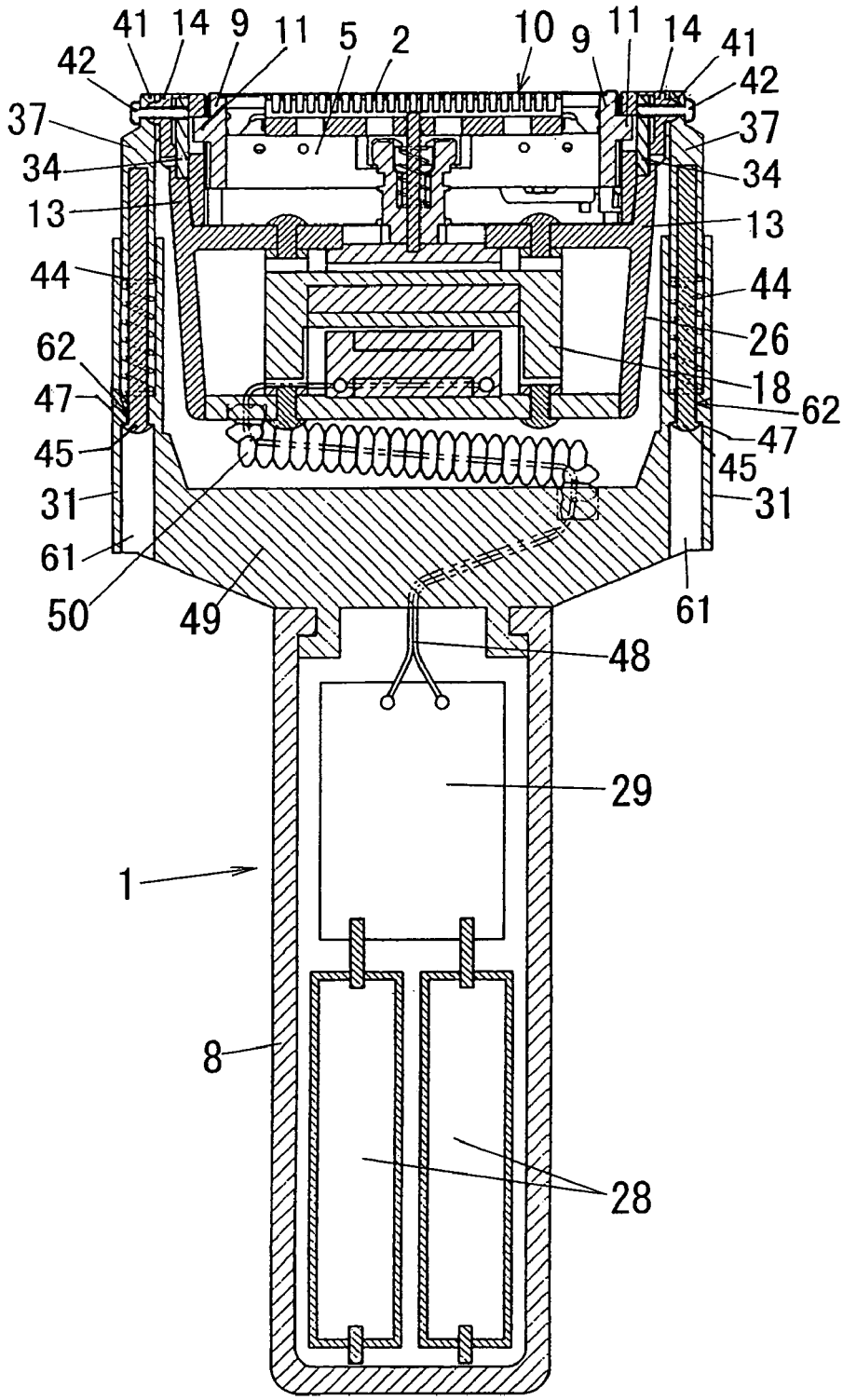
FIG. 12 is a cross sectional view of a reciprocating electric shaver according to Embodiment 3.

Referring now to FIG. 12, Embodiment 3 of the present invention will be described. A reciprocating electric shaver 1 according to this embodiment has a configuration similar to Embodiment 1, which will be explained in no more detail, but is different from Embodiment 1 in that it has a wire 48, for supply of electric power to a linear motor 18, running through the inside of a main body block 8, exposed out of the right end of the upper surface of a cutter head holding body 49, and then drawn into the inside of an outer cutter frame 26 at the left end of the under surface thereof, for connection to the linear motor 18. The exposed portion of the wire 48 is covered with a flexible cover 50, both ends of which are sealed.

The above configuration allows the wire 48 to be extended by using the space between the right end of the upper surface of the cutter head holding body 49 and the left end of the under surface of the outer cutter frame 26, for minimizing bend of the wire 48 in response to position change of a head block 10. As a result, the reaction force caused by bend of the wire 48 can be reduced when the head block 10 performs a rocking motion, so that the head block 10 can conform to the contour of the skin excellently.

This application is based on Japanese Patent Application No. 2001-292456, filed on Sep. 25, 2001, the contents of which are hereby incorporated by reference.

What is claimed is:

1. A reciprocating electric shaver having a main body block and a head block connected to an upper part of the main body block, the head block including arched outer cutters aligned in a front-rear direction of the shaver and blades which perform reciprocating motion, in a transverse direction of the shaver, in contact with insides of the outer cutters, wherein the head block includes four rotary connecting portions at front and rear positions on upper left and upper right ends for connection between the head block and the main body block, wherein the main body block includes four head support members, each of which can move up and down independently, and biasing members biasing upward the corresponding head support members for floating, and wherein each of the head support members of the main body block is connected at an upper end thereof with each of the four rotary connecting portions in a manner such that the head block can rotate back and forth about the transverse direction of the shaver, thus allowing the head block to rock back and forth relative to the main body block.

2. A reciprocating electric shaver according to claim 1, further comprising structures allowing a transverse distance between the upper end of each of the head support members and a corresponding rotary connecting portion of the head block to be freely changed, thus allowing the head block to rock side to side relative to the main body block.

3. A reciprocating electric shaver according to claim 2, wherein the structures allowing the change of the transverse distance each includes a pin penetrating in the transverse direction the upper end of the head support member and the rotary connecting portion of the head block for connection therebetween and a spring member retaining the pin in a manner that allows the pin to move sideways.

4. A reciprocating electric shaver according to claim 1, wherein, of the four rotary connecting portions, either two rotary connecting portions at the front positions on the left and the right ends of the head block or two rotary connecting portions at the rear positions on the left and the right ends of the head block are constructed to be prevented from moving back and forth relative to the corresponding head support members while the other rotary connecting portions are constructed to be movable back and forth relative to the corresponding head support members.

5. A reciprocating electric shaver according to claim 4, wherein, in order to allow the rotary connecting portion to move back and forth relative to the head support member, the head support member has at the upper end an elongate hole extending in the front-rear direction and the head support member is connected with the rotary connecting portion through the elongate hole.

6. A reciprocating electric shaver according to claim 4, wherein, in order to allow the rotary connecting portion to move back and forth relative to the head support member, the head support member is formed by coupling two members as one member of them can rotate back and forth relative to the other member.

7. A reciprocating electric shaver according to claim 4, wherein the two rotary connecting portions at the rear positions on the left and the right ends of the head block are constructed to be movable back and forth relative to the corresponding head support members.

8. A reciprocating electric shaver according to claim 1, wherein, at the left and the right ends of the head block, the rear rotary connecting portions are provided at positions lower than positions of the front rotary connecting portions.

9. A reciprocating electric shaver according to claim 1, wherein, at the left and the right ends of the head block, the front rotary connecting portions are provided closer to the middle position in the front-rear direction of the head block than the rear rotary connecting portions are.

10. A reciprocating electric shaver according to claim 1, wherein, at the left and the right ends of the head block, floating amount of the front rotary connecting portions is greater than floating amount of the rear rotary connecting portions.

11. A reciprocating electric shaver according to claim 1, wherein, at the left and the right ends of the head block, floating force for the front rotary connecting portions is smaller than floating force for the rear rotary connecting portions.

12. A reciprocating electric shaver according to claim 1, wherein the main body block further includes cylindrical guide portions guiding the head support members in the vertical direction and penetrating screws inserted upward into the guide portions for connection with the head support members, and wherein lower parts of the head support members and the biasing members are accommodated in the guide portions, and each of the penetrating screws allows the corresponding head support member to be vertically movable relative to the main body block independent of other head support members.

13. A reciprocating electric shaver according to claim 1, further comprising a drive unit accommodated in the head block for imparting reciprocating motion to the blades.

14. A reciprocating electric shaver according to claim 13, wherein the main body block further includes a power source for the drive unit accommodated in the head block, and wherein the power source and the drive unit are connected via a wire running through a side of the main body block and a side of the head block.

15. A reciprocating electric shaver according to claim 13, wherein the main body block further includes a power source for the drive unit accommodated in the head block, and wherein the power source and the drive unit are connected via a wire running through a side of the main body block and through around a middle position between the front rotary connecting portion and the rear rotary connecting portion on a left or right side of the head block.

16. A reciprocating electric shaver according to claim 14, further comprising a flexible cover covering the wire, wherein both ends of the flexible cover are sealed such that the main body block and the head block can be waterproof.

17. A reciprocating electric shaver according to claim 1, wherein the head block includes an outer cutter cassette having the outer cutters at an upper part thereof, and wherein the outer cutter cassette includes a portion for engagement with the head block and a button portion for releasing the engagement with the head block by using the engaging portion.

* * * * *